US009647333B2

(12) United States Patent
Lv et al.

(10) Patent No.: US 9,647,333 B2
(45) Date of Patent: May 9, 2017

(54) ARRAY ANTENNA, CONFIGURATION METHOD, AND COMMUNICATION SYSTEM

(71) Applicant: Huawei Technologies CO., Ltd., Shenzhen (CN)

(72) Inventors: Rui Lv, Chengdu (CN); Meng Cai, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 45 days.

(21) Appl. No.: 14/728,131

(22) Filed: Jun. 2, 2015

(65) Prior Publication Data

US 2015/0263422 A1 Sep. 17, 2015

Related U.S. Application Data

(63) Continuation of application No. PCT/CN2012/085942, filed on Dec. 5, 2012.

(51) Int. Cl.
*H01Q 3/16* (2006.01)
*H01Q 15/18* (2006.01)
(Continued)

(52) U.S. Cl.
CPC ..... *H01Q 3/16* (2013.01); *H01Q 15/14* (2013.01); *H01Q 15/18* (2013.01);
(Continued)

(58) Field of Classification Search
None
See application file for complete search history.

(56) References Cited

U.S. PATENT DOCUMENTS 2,969,542 A 1/1961 Coleman et al.
5,063,389 A * 11/1991 Reits ..... H01Q 3/01 342/359
(Continued)

FOREIGN PATENT DOCUMENTS

CN 1283316 A 2/2001
CN 1438782 A 8/2003
(Continued)

OTHER PUBLICATIONS

Schell, A.C. The Multiplate Antenna, IEEE Transactions on antenna and Propagation, vol. AP-14, No. 5, Sep. 1966.*

*Primary Examiner* — Howard Williams
(74) *Attorney, Agent, or Firm* — Slater Matsil, LLP

(57) ABSTRACT

Embodiments of the present invention relate to the communication field and provide an array antenna. The array antenna includes: an antenna body, which is a multi-beam antenna, a single-beam antenna without grating lobes, or a single-beam antenna with grating lobes and transmits or receives a beam set by centering on the antenna body, where the beam set includes at least one beam; a planar reflection board, configured to reflect the beam set transmitted or received by the antenna body; and an adjusting unit, connected to the antenna body and/or the planar reflection board, and configured to adjust a relative position between the planar reflection board and the beam set of the antenna body so that the beam set of the antenna body can be transmitted or received in any direction after being reflected by the planar reflection board.

18 Claims, 3 Drawing Sheets

(51) Int. Cl.

| | |
|---|---|
| ***H01Q 19/10*** | (2006.01) |
| ***H01Q 15/14*** | (2006.01) |
| ***H01Q 25/00*** | (2006.01) |
| ***H01Q 19/19*** | (2006.01) |

(52) U.S. Cl.
CPC ..... *H01Q 19/106* (2013.01); *H01Q 19/192* (2013.01); *H01Q 25/007* (2013.01)

(56) References Cited

U.S. PATENT DOCUMENTS

| | | | | |
|---|---|---|---|---|
| 6,031,502 | A * | 2/2000 | Ramanujam | H01Q 1/18 343/761 |
| 6,034,634 | A | 3/2000 | Karlsson et al. | |
| 6,411,255 | B2 * | 6/2002 | Roederer | 342/371 |
| 6,911,950 | B2 * | 6/2005 | Harron | H01Q 3/08 343/765 |
| 7,006,053 | B2 | 2/2006 | Zigler et al. | |
| 7,095,383 | B2 | 8/2006 | Zigler et al. | |
| 7,839,349 | B1 | 11/2010 | West | |
| 7,932,868 | B2 * | 4/2011 | Legay | H01Q 1/288 343/761 |
| 2001/0020914 | A1 | 9/2001 | Roederer | |
| 2003/0153361 | A1 | 8/2003 | Mori et al. | |
| 2004/0217908 | A1 | 11/2004 | Zigler et al. | |
| 2005/0052325 | A1 | 3/2005 | Zigler et al. | |
| 2009/0135076 | A1 | 5/2009 | Foo | |

FOREIGN PATENT DOCUMENTS

| | | | |
|---|---|---|---|
| CN | 2733627 | Y | 10/2005 |
| CN | 101136504 | A | 3/2008 |
| CN | 102480025 | A | 5/2012 |
| EP | 1120856 | A1 | 8/2001 |
| WO | 2005060045 | A1 | 6/2005 |

* cited by examiner

ARRAY ANTENNA, CONFIGURATION METHOD, AND COMMUNICATION SYSTEM

This application claims the benefit of International Application No. PCT/CN2012/085942, filed on Dec. 5, 2012, which is hereby incorporated by reference in its entirety.

TECHNICAL FIELD

The present invention relates to the communication field, and in particular, to an array antenna, a configuration method, and a communication system.

BACKGROUND

An array antenna is a group of two or more single antennas arranged in a certain space. Array antennas include: multi-beam antenna, single-beam antenna without grating lobes, and single-beam antenna with grating lobes. The multi-beam antenna is an antenna that uses phase shift control to intentionally generate multiple expected beam orientations. When a grating lobe of the single-beam antenna with the grating lobes is an adjustable single beam generated on the array antenna, due to limitations of physical parameters, image beams are generated in other directions, and the grating lobe leaks energy in unexpected directions.

In the prior art, because all beams of the array antenna are transmitted or received by centering on the antenna, the beam transmitting angle of the array antenna is restricted by the structure of the array antenna, and the angle of the beam in the array antenna is not flexibly adjustable.

SUMMARY

Embodiments of the present invention provide an array antenna, a configuration method, and a communication system to implement flexible adjustment of a beam angle in the array antenna.

To achieve this objective, the embodiments of the present invention employ the following technical solutions:

In one aspect, an array antenna is provided, including:

an antenna body, which is a multi-beam antenna, a single-beam antenna without grating lobes, or a single-beam antenna with grating lobes and transmits or receives a beam set by centering on the antenna body, where the beam set includes at least one beam;

a planar reflection board, configured to reflect the beam set transmitted or received by the antenna body; and an adjusting unit, connected to the antenna body and/or the planar reflection board, and configured to adjust a relative position between the planar reflection board and the beam set of the antenna body so that the beam set of the antenna body can be transmitted or received in any direction after being reflected by the planar reflection board.

The adjusting unit is configured to adjust a relative position between the planar reflection board and the beam set of the antenna body so that the beam set of the antenna body can be transmitted or received in parallel after being reflected by the planar reflection board.

The adjusting unit includes a first adjusting subunit, where the first adjusting subunit is connected to the antenna body, and the first adjusting subunit is configured to: when a position of the planar reflection board is fixed, adjust a position of the beam set of the array antenna body so that the beam set of the antenna body can be transmitted or received in parallel after being reflected by the planar reflection board.

The adjusting unit includes a second adjusting subunit, where the second adjusting subunit is connected to the planar reflection board, and the second adjusting subunit is configured to: when a position of the antenna body is fixed, adjust a position of the planar reflection board so that the beam set of the antenna body can be transmitted or received in parallel after being reflected by the planar reflection board.

The adjusting unit includes a third adjusting subunit, where the third adjusting subunit is connected to both the planar reflection board and the antenna body, and the third adjusting subunit is configured to: when the number or position of beams in the beam set of the antenna body is changed, adjust a position of the planar reflection board so that the beam set of the antenna body can be transmitted or received in parallel after being reflected by the planar reflection board.

The second adjusting subunit is a hinge, a gemel, or an electric motor.

When the antenna body is the multi-beam antenna, the number of the planar reflection boards is greater than or equal to the number of beams of the antenna body.

When the antenna body is the single-beam antenna with grating lobes, the number of the planar reflection boards is greater than or equal to a sum of the number of the grating lobes in the antenna body and single beam.

In one aspect, an array antenna configuration method is provided, where the antenna configuration method is applied to a multi-beam antenna and includes: adjusting a relative position between a planar reflection board and a beam set of the multi-beam antenna so that the beam set of the multi-beam antenna can be transmitted or received in parallel after being reflected by the planar reflection board, where the number of the planar reflection boards is greater than or equal to the number of beams of the antenna body.

In one aspect, another array antenna configuration method is provided, where the antenna configuration method is applied to a single-beam antenna with grating lobes and includes: adjusting a relative position between a planar reflection board and a beam set of the single-beam antenna with grating lobes so that the beam set of the single-beam antenna with grating lobes can be transmitted or received in parallel after being reflected by the planar reflection board, where the number of the planar reflection boards is greater than or equal to the number of beams of the antenna body.

In one aspect, a communication system is provided, including:

at least one array antenna, where the array antenna includes an antenna body, a planar reflection board, and an adjusting unit, where: the antenna body is a multi-beam antenna, a single-beam antenna without grating lobes, or a single-beam antenna with grating lobes, and the antenna body transmits or receives a beam set by centering on the antenna body, where the beam set includes at least one beam; the planar reflection board is configured to reflect the beam set transmitted or received by the antenna body; and the adjusting unit is connected to the antenna body and/or the planar reflection board, and configured to adjust a relative position between the planar reflection board and the beam set of the antenna body so that the beam set of the antenna body can be transmitted or received in any direction after being reflected by the planar reflection board.

The communication system further includes a transmitting antenna and a receiving antenna, where both the transmitting antenna and the receiving antenna are the array antennas.

The embodiments of the present invention provide an array antenna, a configuration method, and a communication system, where the array antenna includes: an antenna body, which is a multi-beam antenna or a single-beam antenna without grating lobes or a single-beam antenna with grating lobe and transmits or receives a beam set by centering on the antenna body, where the beam set includes at least one beam; a planar reflection board, configured to reflect the beam set transmitted or received by the antenna body; and an adjusting unit, connected to the antenna body and/or the planar reflection board, and configured to adjust a relative position between the planar reflection board and the beam set of the antenna body so that the beam set of the antenna body can be transmitted or received in any direction after being reflected by the planar reflection board. In this way, the adjusting unit adjusts a relative position between the planar reflection board and the beam set of the antenna body, and therefore, the beams in the array antenna can be transmitted or received in any direction and the beam angle in the array antenna can be adjusted flexibly.

BRIEF DESCRIPTION OF THE DRAWINGS

To illustrate the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
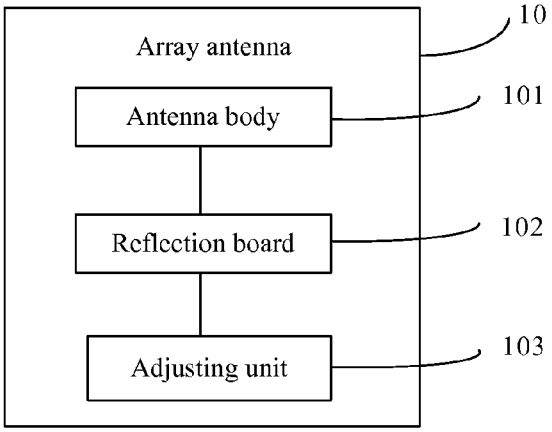
FIG. 1 is a schematic structural diagram of an array antenna according to an embodiment of the present invention.

An embodiment of the present invention provides an array antenna 10. As shown in FIG. 1, the array antenna includes:

an antenna body 101, which is a multi-beam antenna, a single-beam antenna without grating lobes, or a single-beam antenna with grating lobes and transmits or receives a beam set by centering on the antenna body 101, where the beam set includes at least one beam;

a planar reflection board 102, configured to reflect the beam set transmitted or received by the antenna body 101, where the number of the planar reflection board 102 may be one or more; and an adjusting unit 103, connected to the antenna body 101 and/or the planar reflection board 102, and configured to adjust a relative position between the planar reflection board 102 and the beam set of the antenna body 101 so that the beam set of the antenna body 101 can be transmitted or received in any direction after being reflected by the planar reflection board 102.

In this way, the adjusting unit adjusts a relative position between the planar reflection board and the beam set of the antenna body, and therefore, the beams in the array antenna can be transmitted or received in any direction and the beam angle in the array antenna can be adjusted flexibly.

It should be noted that the embodiment of the present invention does not restrict the material of the planar reflection board. In practical application, the reflection plane near the antenna body on the planar reflection board may be coated with aluminum, copper, or another material of low electromagnetic loss performance so that each reflection plane is flat, smooth, and free of protrusions and recesses.

Especially, the adjusting unit is configured to adjust a relative position between the planar reflection board and the beam set of the antenna body so that the beam set of the antenna body can be transmitted or received in parallel after being reflected by the planar reflection board.

In the prior art, a relay node needs to interconnect beams between two multi-beam antennas to implement point-to-point communication of the multi-beam antennas. In the embodiment of the present invention, when the antenna body is the multi-beam antenna, the adjusting unit adjusts the relative position between the planar reflection board and the beam set of the antenna body, and therefore, multiple beams oriented to different directions in the array antenna are directly sent by the transmitter to the same receiver at the same time, and all the beams of the array antenna are transmitted or received in parallel, without requiring a relay node to interconnect beams between two multi-beam antennas. In this way, point-to-point direct communication is implemented between multi-beam antennas. When the antenna body is a single-beam antenna with grating lobes, the adjusting unit adjusts the relative position between the planar reflection board and the beam set of the antenna body, and therefore, multiple beams oriented to different directions in the array antenna are directly sent by the transmitter to the same receiver at the same time, all grating lobes of the single-beam antenna with grating lobes and the adjustable single beam are transmitted or received in the same direction, no energy is leaked in unexpected directions, and energy loss caused by emission from grating lobes is reduced.

Specifically, the adjusting unit may include a first adjusting subunit, where the first adjusting subunit is connected to the antenna body, and the first adjusting subunit is configured to: when a position of the planar reflection board is fixed, adjust a position of the beam set of the array antenna body so that the beam set of the antenna body can be transmitted or received in parallel after being reflected by the planar reflection board. Especially, in practical application, the adjustment of the position of the beam set may be performed manually.

The adjusting unit may further include a second adjusting subunit, where the second adjusting subunit is connected to the planar reflection board, and the second adjusting subunit is configured to: when a position of the antenna body is fixed, adjust a position of the planar reflection board so that the beam set of the antenna body can be transmitted or received in parallel after being reflected by the planar reflection board. The second adjusting subunit is a hinge, a gemel, or an electric motor. In practical application, the number of the second adjusting subunits may be one or more. When the second adjusting subunit is a hinge or gemel, the hinge or gemel may be set between adjacent planar reflection boards to adjust the angle of the planar reflection board and adjust the position of the planar reflection board. When the second adjusting subunit is an electric motor, the electric motor may be connected to each planar reflection board respectively to drive position change of each planar reflection board.

The adjusting unit includes a third adjusting subunit, where the third adjusting subunit is connected to both the planar reflection board and the antenna body, and the third adjusting subunit is configured to: when the number or position of beams in the beam set of the antenna body is changed, adjust a position of the planar reflection board so that the beam set of the antenna body can be transmitted or received in parallel after being reflected by the planar reflection board. Especially, the third adjusting subunit may adjust the number or position of beams in the beam set of the antenna body.

It should be noted that when the antenna body is a multi-beam antenna, the number of the planar reflection boards is greater than or equal to the number of beams of the antenna body; when the antenna body is a single-beam antenna without grating lobes, no requirement is imposed on the number of the planar reflection boards; and, when the antenna body is a single-beam array antenna with grating lobes, the number of the planar reflection boards is greater than or equal to a sum of the number of the grating lobes in the antenna body and single beam.

Figure 2:
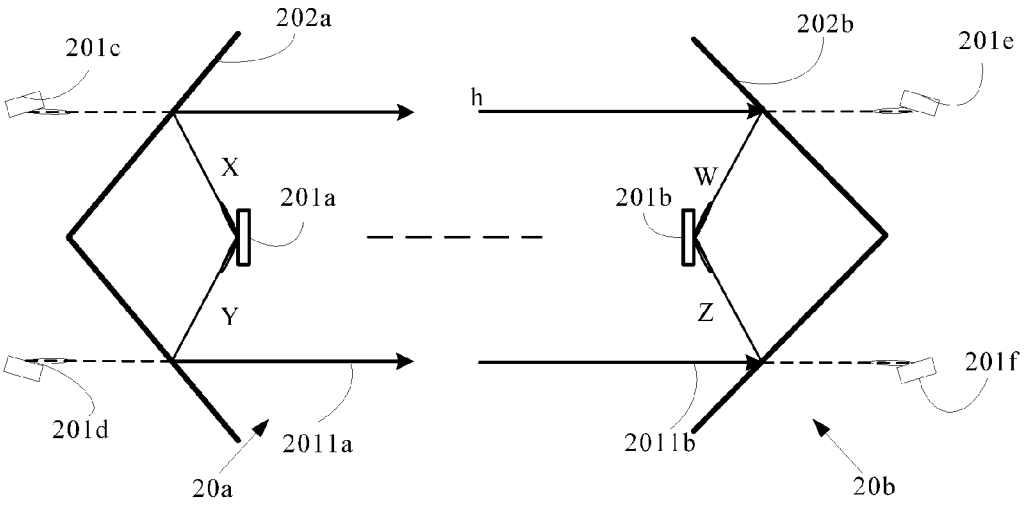
FIG. 2 is a schematic structural diagram of a communication system according to an embodiment of the present invention.

For example, as shown in FIG. 2, a communication system includes a transmitting antenna 20*a* and a receiving antenna 20*b*, where both the transmitting antenna 20*a* and the receiving antenna 20*b* are the array antennas provided in the embodiment of the present invention. The transmitting antenna 20*a* includes: a first antenna body 201*a*, which is an antenna with two beams and transmits a first beam set 2011*a* to the outside by centering on the first antenna body 201*a*, where the first beam set 2011*a* includes two beams; the first planar reflection board 202*a* is configured to reflect the first beam set 2011*a* transmitted by the first antenna body 201*a*; and a first adjusting unit (not shown in FIG. 2), connected to the first antenna body 201*a* and/or the first planar reflection board 202*a*, and configured to adjust a relative position between the first planar reflection board 202*a* and the first beam set 2011*a* of the first antenna body 201*a* so that the first beam set 2011*a* of the first antenna body 201*a* can be transmitted in parallel after being reflected by the first planar reflection board 202*a*. The first adjusting unit may be the first adjusting subunit, the second adjusting subunit, or the third adjusting subunit. The first planar reflection board 202*a* is adjusted to the position shown in FIG. 2 so that the beams X and Y in the first beam set 2011*a* can be transmitted in parallel in the same direction. The number of the first planar reflection boards 202*a* may be greater than or equal to the number of the first beam sets 2011*a* of the first antenna body 201*a*. In this embodiment, the number of the first planar reflection boards 202*a* is equal to the number of the first beam sets 2011*a* of the first antenna body 201*a*.

The receiving antenna 20*b* includes: a second antenna body 201*b*, which receives two beams and receives a second beam set 2011*b* by centering on the second antenna body 201*b*, where the second beam set 2011*b* includes two beams; the second planar reflection board 202*b* is configured to reflect the second beam set 2011*b* received by the second antenna body 201*b*; and a second adjusting unit (not shown in FIG. 2), connected to the second antenna body 201*b* and/or the second planar reflection board 202*b*, and configured to adjust a relative position between the second planar reflection board 202*b* and the second beam set 2011*b* of the second antenna body 201*b* so that the second beam set 2011*b* of the second antenna body 201*b* can be transmitted in parallel after being reflected by the second planar reflection board 202*b*. The second adjusting unit may be the first adjusting subunit, the second adjusting subunit, or the third adjusting subunit. The second planar reflection board 202*b* is adjusted to the position shown in FIG. 2 so that the second beam set 2011*b* receives beams W and Z sent in parallel from the same direction. The number of the second planar reflection boards 202*b* may be greater than or equal to the number of the second beam sets 2011*b* of the second antenna body 201*b*. In this embodiment, the number of the second planar reflection boards 202*b* is equal to the number of the second beam sets 2011*b* of the second antenna body 201*b*. Especially, in this communication system, the beam X and the beam W may be the same beam, and the beam Y and the beam Z may be the same beam.

Specifically, taking the beam X as an example, after the beam X of the transmitting antenna 20*a* is transmitted from the first antenna body 201*a*, reflected by the first planar reflection board 202*a* and emitted to the receiving antenna 20*b* in the h direction shown in FIG. 2, the second antenna body 201*b* of the receiving antenna 20*b* may receive the beam X in the h direction shown in FIG. 2. The beam X is reflected by the second planar reflection board 202*b* and then sent to the second antenna body 201*b* in the form of the beam W, whereupon the second antenna body 201*b* receives the beam W.

Figure 3:
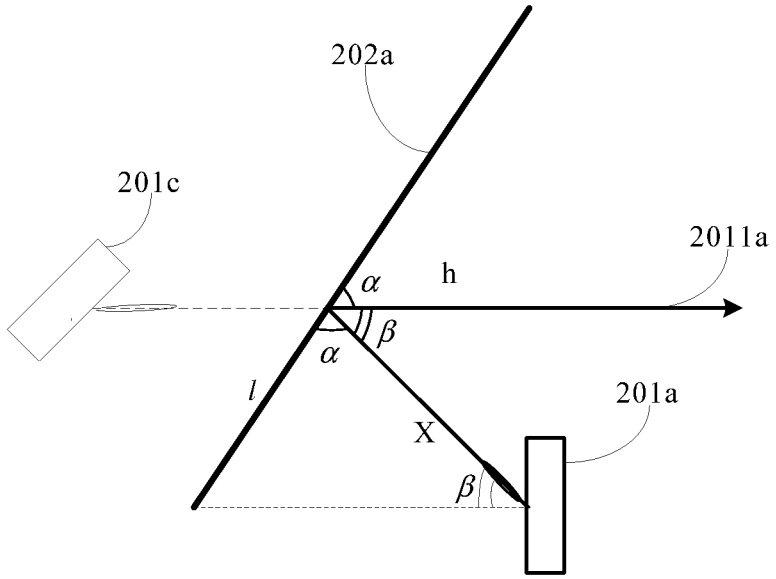
FIG. 3 is a partial schematic diagram of an array antenna structure shown in FIG. 2 according to an embodiment of the present invention.

Specially, to ensure that all beams of the antenna body are emitted in parallel along the same direction or that the antenna body receives all beams sent in parallel in the same direction, as shown in FIG. 3, which is a partial schematic diagram of a transmitting antenna 20*a* shown in FIG. 2, an angle $\alpha$ exists between the first planar reflection board 202*a* and the first beam 2011*a*, $0°<\alpha<180°$, an angle $\beta$ exists between the beam X and the normal direction of the first antenna body 201*a*, and $2\alpha+\beta=180°$ this way, the beam reflected by the first planar reflection board 202*a* is emitted along the normal direction of the first antenna body 201*a*. For the angle relationships between the beam Y, the beam W, the beam Z, and the antenna body in FIG. 2, reference may be made to the illustration in FIG. 3, and no repeated description is given here any further.

Figure 4:
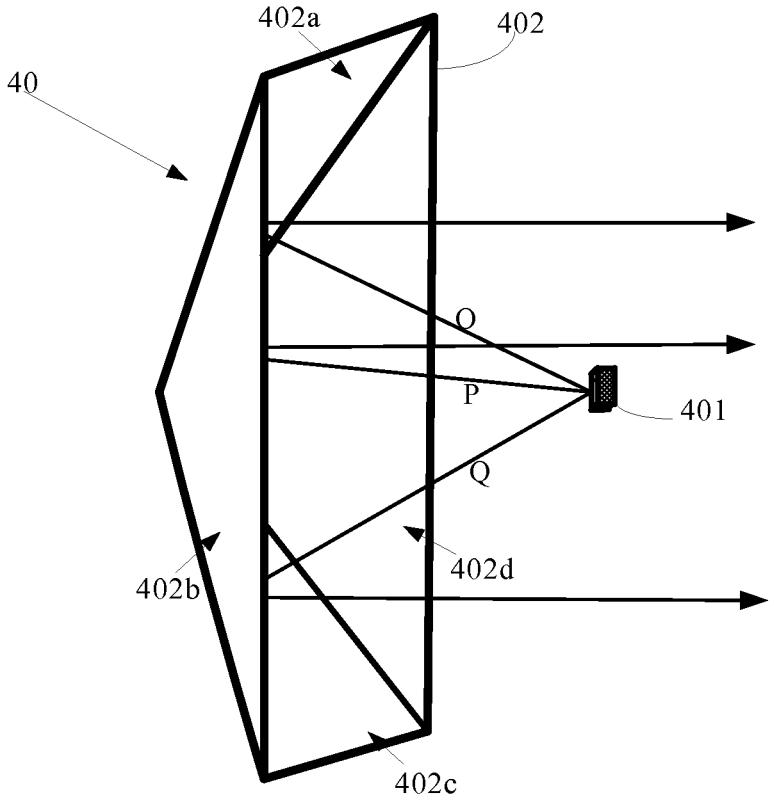
FIG. 4 is a schematic structural diagram of another array antenna according to an embodiment of the present invention.

Further, the antenna body 401 in FIG. 4 is a 3-beam array antenna, there are four planar reflection boards 402 in total, and the third adjusting unit (not shown in FIG. 4) is connected to the antenna body 401 and/or the planar reflection board 402, and configured to adjust the relative position between the planar reflection board 402 and the three beams of the antenna body 401 so that the three beams of the antenna body 401 can be transmitted in parallel after being reflected by the planar reflection board 402. The third adjusting unit may be the first adjusting subunit, the second adjusting subunit, or the third adjusting subunit. In this embodiment, the planar reflection boards 402 are 402*a*, 402*b*, 402*c*, and 402*d*, the antenna body 401 transmits beams

0, P, and Q, the beam 0 is reflected by the planar reflection board 402*a*, the beam P is reflected by the planar reflection board 402*b*, the beam Q is reflected by the planar reflection board 402*c*, and the reflected beams 0, P, and Q are parallel and emitted in the same direction. In the array antenna 40, the planar reflection board 402*d* is not in use. If the antenna body 401 is a 4-beam antenna, the planar reflection board 402*d* may be put into use. It should be noted that in practical application, the number of beams of the array antenna and the number of planar reflection boards may be adjusted according to specific conditions. Any variations or replacements made by persons skilled in the art without departing from the technical scope disclosed herein shall fall within the protection scope of the present invention, and the variations are not detailed here any further.

In the prior art, beams oriented to different directions in the multi-beam antenna are emitted to the outside by centering on the antenna, and the beams oriented to different directions cannot be transmitted or received in parallel. In the array antenna provided in the embodiment of the present invention, the adjusting unit adjusts the relative position between the beam set and the planar reflection board, so that all beams of the antenna body are emitted in parallel in the same direction or the antenna body receives all beams transmitted in parallel in the same direction. In this way, in the communication system shown in FIG. 2, the corresponding beams of the transmitting antenna and the receiving antenna may be aligned to create a direct beam path. Therefore, point-to-point direct communication between the multi-beam antennas is implemented, and LOS-MIMO (Line of Sight-Multiple Input Multiple Output, line of sight-multiple input multiple output) diversity and multiplexing are implemented. The LOS-MIMO multiplexing refers to using the same frequency to transmit signals of different contents on multiple transmitting paths of the MIMO, which improves spectrum usage and increases the communication system capacity. The LOS-MIMO diversity refers to transmitting signals of the same content on multiple transmitting paths of the MIMO, where the diversity improves link reliability under the same transmission distance and increases the link transmission distance without reducing reliability.

Figure 5:
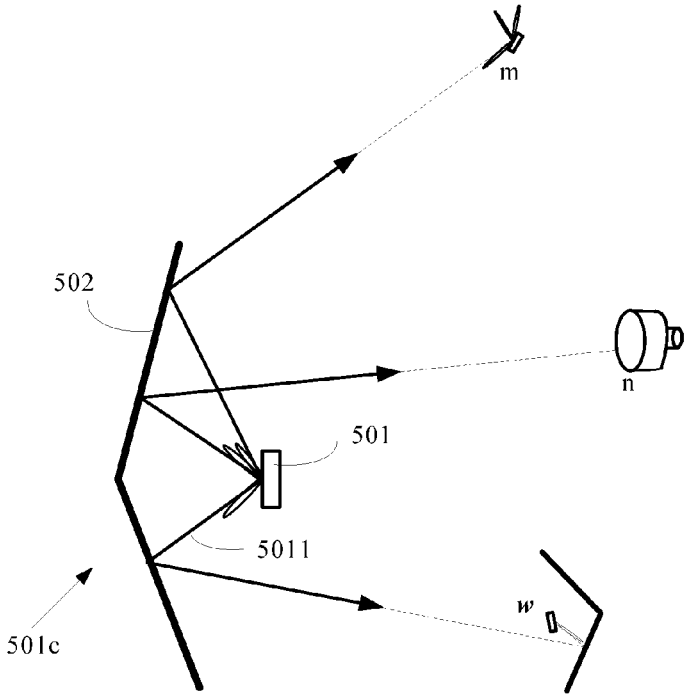
FIG. 5 is a schematic structural diagram of another communication system according to an embodiment of the present invention.

Especially, when the antenna body is a multi-beam antenna, point-to-multi-point communication can also be implemented. As shown in FIG. 5, the number of the planar reflection boards 502 and the number of the beam sets 5011 are in no restrictive relationships, and multiple planar reflection boards 502 may work at the same time. For example, the array antenna may include: an antenna body 501, configured to transmit three beams by centering on the antenna body 501; a planar reflection board 502, configured to reflect the three beams transmitted by the antenna body 501; and a first adjusting subunit (not shown in FIG. 5), where the first adjusting subunit is connected to the antenna body 501, and the first adjusting subunit is configured to: when the position of the planar reflection board 502 is fixed, adjust the position of the three beams of the antenna body 501 so that the three beams of the antenna body 501 can be transmitted in parallel after being reflected by the planar reflection board 502. As shown in FIG. 5, after being reflected by the planar reflection board 502, the three beams of the array antenna 501 are transmitted to the antenna m, the antenna n, and the antenna w that are in different positions, thereby implementing point-to-multi-point communication of multiple beams. Especially, the three beams may carry the same information to the antenna m, the antenna n, and the antenna w to implement broadcast communication, or carry different information to the antenna m, the antenna n, and the antenna w to implement point-to-multi-point independent communication. It should be noted that the embodiment of the present invention does not limit the type of the antenna m, the antenna n, and the antenna w; and the antenna m, the antenna n, and the antenna w may be multi-beam antennas, single-beam antennas or antennas of the same type as the transmitting antenna. For example, in the embodiment of the present invention, the antenna m is set to be a multi-beam antenna, the antenna n is set to be a single-beam antenna, and the antenna w is set to be an antenna of the same type as the transmitting antenna, that is, array antenna 501.

For example, when the antenna body is a single-beam antenna with grating lobes, the configuration mode of the array antenna may be shown in FIG. 2, and the number of the planar reflection boards may be greater than or equal to the sum of the number of the grating lobes in the antenna body and the single beam. Because the number of the single beam in the single-beam antenna with grating lobes is 1, the number of the planar reflection boards is greater than or equal to the number of the grating lobes in the antenna body plus 1. It should be noted that the single beam in the single-beam antenna with grating lobes is also known as a principal beam. In this embodiment, the adjusting unit is a second adjusting subunit (not shown in FIG. 2), where the second adjusting subunit is connected to the planar reflection board, and the second adjusting subunit is configured to: when a position of the antenna body is fixed, adjust a position of the planar reflection board so that the beam set of the antenna body can be transmitted or received in parallel after being reflected by the planar reflection board. Because all beams in the single-beam antenna with grating beams carry the same signal content, LOS-MIMO point-to-point diversity transmission can be implemented. All beams in the single-beam antenna with grating beams in this embodiment refer to multiple beams composed of the grating lobes and the single beam. In the single-beam antenna with grating lobes, the adjustment of the planar reflection board may use corresponding image antennas as a reference system. As shown in FIG. 2, the first antenna 201*c* and the second antenna 201*d* are image antennas generated by the first antenna body 201*a* by using the first planar reflection board 202*a* as an image plane, and the third antenna 201*e* and the fourth antenna 201*f* are image antennas generated by the second antenna body 201*b* by using the second planar reflection board 202*b* as an image plane, where the number of the image antennas may be equal to the number of the planar reflection boards, and the image antennas are virtual antennas. As shown in FIG. 3, the first antenna 201*c* is an image antenna generated by the first antenna body 201*a* by using planar reflection board 1 in the first planar reflection board 202*a* as an image plane. If the first antenna 201*c* has an actual beam source, the reflected beam of the beam source may be propagated along a straight line of the direction h. Therefore, the first antenna 201*c* may be regarded as an equivalent beam source of the first antenna body 201*a*. At the time of adjusting the position of the planar reflection board 1, the first antenna 201*c* is used as a reference system of the position of the planar reflection board 1 to calculate the angle between the planar reflection board to be adjusted and the antenna body, which makes the adjustment process simpler and more convenient. Similarly, the adjustment of other planar reflection boards in FIG. 2 may also use corresponding image antennas as a reference system, which is not detailed here any further.

Figure 6:
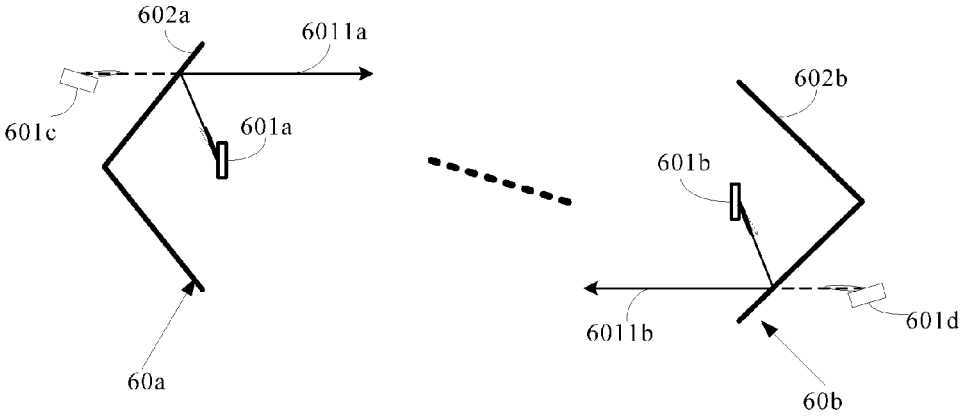
FIG. 6 is a schematic structural diagram of another communication system according to an embodiment of the present invention.

Especially, the transmitting antenna and the receiving antenna in the communication system may be single-beam antennas. As shown in FIG. 6, the communication system includes a transmitting antenna 60*a* and a receiving antenna 60*b*, where both the transmitting antenna 60*a* and the receiving antenna 60*b* are the array antennas provided in the embodiment of the present invention. The transmitting antenna 60*a* includes: a third antenna body 601*a*, which is a single-beam antenna without grating lobes and transmits a third beam 6011*a* to the outside by centering on the third antenna body 601*a*; a third planar reflection board 602*a*, configured to reflect the beam 6011*a* transmitted by the third antenna body 601*a*; and a first adjusting subunit (not shown in FIG. 6), where the first adjusting subunit is connected to the third planar reflection board 602*a*, and the first adjusting subunit is configured to: when the position of the third antenna body 601*a* is fixed, adjust the position of the third planar reflection board 602*a* so that the beam of the third antenna body 601*a* can be transmitted in parallel after being reflected by the third planar reflection board 602*a*. When the first adjusting subunit adjusts the angle between the third beam 6011*a* and the third planar reflection board 602*a*, the corresponding image antenna may be used as a reference system. The number of the third planar reflection boards 602*a* in the transmitting antenna 60*a* is not limited, and the position adjustment performed by the first adjusting subunit for the third planar reflection board 602*a* needs to prevent obstructions from blocking beams between the third antenna body 601*a* and the third planar reflection board 602*a*. When the third planar reflection board 602*a* adjusts the angle of the third beam 6011*a*, the corresponding image antenna 601*c* may be used as a reference system.

The receiving antenna 60*b* includes: a fourth antenna body 601*b*, which is a single-beam antenna without grating lobes and receives a fourth beam 6011*b* by centering on the fourth antenna body 601*b*; a fourth planar reflection board 602*b*, configured to reflect the beam 6011*b* received by the fourth antenna body 601*b*; and a first adjusting subunit (not shown in FIG. 6), where the first adjusting subunit is connected to the fourth planar reflection board 602*b*, and the first adjusting subunit is configured to: when the position of the fourth antenna body 601*b* is fixed, adjust the position of the fourth planar reflection board 602*b* so that the beam of the fourth antenna body 601*b* can receive in parallel the fourth beam 6011*b* reflected by the fourth planar reflection board 602*b*. When the first adjusting subunit adjusts the angle between the fourth beam 6011*b* and the fourth planar reflection board 602*b*, the corresponding image antenna may be used as a reference system.

In this way, the adjusting unit adjusts a relative position between the planar reflection board and the beam set of the antenna body, and therefore, the beams in the array antenna can be transmitted or received in any direction and the beam angle in the array antenna can be adjusted flexibly.

In practical application, according to the type of the generated beam, the array antennas may break down into antennas capable of generating only a single beam with grating lobes and antennas capable of generating both a single beam and multiple beams. The above two types of array antennas have different physical structures. The array antenna configuration method can implement parallel transmitting or receiving of all beams on the two types of array antennas.

An embodiment of the present invention provides an array antenna configuration method, where the antenna configuration method is applied to a multi-beam antenna and includes:

adjusting a relative position between a planar reflection board and a beam set of the multi-beam antenna so that the beam set of the multi-beam antenna can be transmitted or received in parallel after being reflected by the planar reflection board, where the number of the planar reflection boards is greater than or equal to the number of beams of the antenna body.

In this way, the relative position between the planar reflection board and the beam set of the multi-beam antenna is adjusted so that the beam set of the multi-beam antenna can be transmitted or received in parallel after being reflected by the planar reflection board, and parallel transmitting or receiving of all beams of the array antenna is implemented.

Persons skilled in the art clearly understand that for convenient description and brevity, for detailed configuration processes and methods of array antennas in the method described herein, reference may be made to the corresponding processes in the array antenna embodiments, and no repeated description is given here any further.

An embodiment of the present invention provides another array antenna configuration method, where the antenna configuration method is applied to a single-beam antenna with grating lobes and includes:

adjusting a relative position between a planar reflection board and a beam set of the single-beam antenna with grating lobes so that the beam set of the single-beam antenna with grating lobes can be transmitted or received in parallel after being reflected by the planar reflection board, where the number of the planar reflection boards is greater than or equal to the number of beams of the antenna body.

In this way, the relative position between the planar reflection board and the beam set of the single-beam antenna with grating lobes is adjusted so that the beam set of the single-beam antenna with grating lobes can be transmitted or received in parallel after being reflected by the planar reflection board, and parallel transmitting or receiving of all beams of the array antenna is implemented.

Persons skilled in the art clearly understand that for convenient description and brevity, for detailed configuration processes and methods of array antennas in the method described herein, reference may be made to the corresponding processes in the array antenna embodiments, and no repeated description is given here any further.

An embodiment of the present invention provides a communication system, including at least one array antenna, where the array antenna includes an antenna body, a planar reflection board, and an adjusting unit, where: the antenna body is a multi-beam antenna, a single-beam antenna without grating lobes, or a single-beam antenna with grating lobes, and the antenna body transmits or receives a beam set by centering on the antenna body, where the beam set includes at least one beam; the planar reflection board is configured to reflect the beam set transmitted or received by the antenna body; and the adjusting unit is connected to the antenna body and/or the planar reflection board, and configured to adjust a relative position between the planar reflection board and the beam set of the antenna body so that the beam set of the antenna body can be transmitted or received in any direction after being reflected by the planar reflection board. The communication system further includes a transmitting antenna and a receiving antenna, where both the transmitting antenna and the receiving antenna may be the array antennas.

In this way, because the adjusting unit in the array antenna of the communication system is connected to the antenna body and/or the planar reflection board, the adjusting unit can adjust the relative position between the planar reflection board and the beam set of the antenna body, and therefore, the beams in the array antenna can be transmitted or received in any direction and the beam angle in the array antenna can be adjusted flexibly.

It should be noted that the communication system may include a transmitting antenna and a receiving antenna. In the communication system, the transmitting antenna and the receiving antenna generally have the same beam configuration. That is, the number of beams transmitted by the transmitting antenna is equal to the number of beams received by the receiving antenna. In practical application, however, it is appropriate only if the number of beams received by the receiving antenna is greater than the number of beams transmitted by the transmitting antenna. Especially, when the antenna body of the transmitting antenna is a single-beam array antenna with grating lobes, because the beam configuration of the single-beam array antenna with grating lobes is a single beam plus grating lobes, the number of beams received by the receiving antenna may be less than the number of beams transmitted by the transmitting antennas.

It should be noted that the type of the receiving antenna may be the same as or different from that of the transmitting antenna. For example, the communication system shown in FIG. 5 includes a transmitting antenna and a receiving antenna, where the transmitting antenna of the communication system is a multi-beam antenna and the multi-beam antenna includes an antenna body 501, a planar reflection board 502, and a first adjusting subunit (not shown in FIG. 5). The first adjusting subunit is connected to the antenna body 501, and the first adjusting subunit is configured to: when the position of the planar reflection board 502 is fixed, adjust the position of the three beams of the antenna body 501 so that the three beams of the antenna body 501 can be transmitted in parallel after being reflected by the planar reflection board 502. The first adjusting subunit may be further configured to adjust the position of the three beams of the antenna body 501 so that the three beams of the antenna body 501 can be sent to different regions after being reflected by the planar reflection board 502 and that the antenna m, the antenna n and the antenna w in different positions can separately receive the three beams reflected by the planar reflection board. The antenna m, the antenna n, and the antenna w may be multi-beam antennas, single-beam antennas or antennas of the same type as the transmitting antenna. For example, in the embodiment of the present invention, the antenna m is set to be a multi-beam antenna, the antenna n is set to be a single-beam antenna, and the antenna w is set to be an antenna of the same type as the transmitting antenna, that is, array antenna 501.

For example, both the transmitting antenna and the receiving antenna are array antennas. As shown in FIG. 2 or FIG. 6, for configuration of each array antenna in the communication system, reference may be made to the corresponding description in FIG. 2 or FIG. 6 in the embodiments of the present invention, and no detailed description is given here any further.

An embodiment of the present invention provides an array antenna configuration method and a communication system, where the array antenna of the communication system includes an antenna body, a planar reflection board, and an adjusting unit. The adjusting unit may adjust a relative position between the planar reflection board and the beam set of the antenna body, and therefore, the beams in the array antenna can be transmitted or received in any direction and the beam angle in the array antenna can be adjusted flexibly.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An array antenna, comprising:

an antenna body, the antenna body being one of a multi-beam antenna, a single-beam antenna without grating lobes, or a single-beam antenna with grating lobes, wherein the antenna body is a directional antenna configured to emit or receive one or more beams of a beam set, wherein each of the one or more beams is oriented in a single direction, and wherein the array antenna is part of a communication system;

a planar reflection board comprising a planar reflective surface configured to reflect the beam set, wherein all of the planar reflective surface is in a single plane; and an adjusting unit connected to at least one of the antenna body and the planar reflection board, wherein the adjusting unit is configured to adjust a relative position between the planar reflection board and the beam set, wherein the antenna body is configured by the adjusting the relative position to transmit or receive, in any direction, the beam set after being reflected by the planar reflection board.

2. The array antenna according to claim 1, wherein the antenna body is configured by the adjusting the relative position to transmit or receive the beam set in parallel after being reflected by the planar reflection board.

3. The array antenna according to claim 2, wherein the adjusting unit comprises a first adjusting subunit, wherein the first adjusting subunit is connected to the antenna body, and the first adjusting subunit is configured to adjust, when a position of the planar reflection board is fixed, a position of the beam set, wherein the antenna body is configured by the adjusting the position of the beam set to transmit or receive the beam set in parallel after being reflected by the planar reflection board.

4. The array antenna according to claim 2, wherein the adjusting unit comprises a second adjusting subunit, wherein the second adjusting subunit is connected to the planar reflection board, and wherein the second adjusting subunit is configured to adjust, when a position of the antenna body is fixed, a position of the planar reflection board, wherein the antenna body is configured by the adjusting the position of the planar reflection board to transmit or receive the beam set in parallel after being reflected by the planar reflection board.

5. The array antenna according to claim 4, wherein:

the second adjusting subunit is a hinge, a gemel, or an electric motor.

6. The array antenna according to claim 2, wherein the adjusting unit comprises a third adjusting subunit, wherein the third adjusting subunit is connected to both the planar reflection board and the antenna body, and the third adjusting subunit is configured to adjust, when a number or position of beams in the beam set is changed, a position of the planar reflection board, wherein the antenna body is configured by the adjusting the position of the planar reflection board to transmit or receive the beam set in parallel after being reflected by the planar reflection board.

7. The array antenna according to claim 2, wherein the antenna body is the multi-beam antenna; and wherein a number of the planar reflection boards is greater than or equal to a number of beams of the antenna body.

8. The array antenna according to claim 2, wherein the antenna body is the single-beam antenna with grating lobes, and wherein the beam set comprises a single beam and the grating lobes; and wherein a number of the planar reflection boards is greater than or equal to a sum of the number of the grating lobes in the antenna body and the single beam.

9. An array antenna configuration method for a multi-beam antenna, comprising:

adjusting a relative position between a planar reflection board and a beam set of the multi-beam antenna, wherein an antenna body of the multi-beam antenna is configured by the adjusting the relative position to transmit or receive the beam set of the multi-beam antenna in parallel after being reflected by the planar reflection board, wherein the planar reflection board comprises a planar reflective surface, and wherein all of the planar reflective surface is comprised in a single plane; and wherein a number of planar reflection boards is greater than or equal to a number of beams of an antenna body of the multi-beam antenna.

10. The array antenna configuration method according to claim 9, wherein the adjusting comprises adjusting, when a position of the planar reflection board is fixed, a position of the beam set, wherein the antenna body is configured by the adjusting the position of the beam set to transmit or receive the beam set in parallel after being reflected by the planar reflection board.

11. The array antenna configuration method according to claim 9, wherein the adjusting comprises adjusting, when a position of the antenna body is fixed, a position of the planar reflection board, wherein the antenna body is configured by the adjusting the position of the planar reflection board to transmit or receive the beam set in parallel after being reflected by the planar reflection board.

12. The array antenna configuration method according to claim 11, wherein:

the adjusting is performed using a hinge, a gemel, or an electric motor.

13. The array antenna configuration method according to claim 9, wherein the adjusting comprises adjusting, when a number or position of beams in the beam set is changed, a position of the planar reflection board, wherein the antenna body is configured by the adjusting the position of the planar reflection board to transmit or receive the beam set in parallel after being reflected by the planar reflection board.

14. An array antenna configuration method for a single-beam antenna with grating lobes, comprising:

adjusting a relative position between a planar reflection board and a beam set of the single-beam antenna having grating lobes, wherein an antenna body of the single-beam antenna is configured by the adjusting the relative position to transmit or receive the beam set of the single-beam antenna with grating lobes in parallel after being reflected by the planar reflection board, wherein the planar reflection board comprises a planar reflective surface, and wherein all of the planar reflective surface is comprised in a single plane; and wherein a number of planar reflection boards is greater than or equal to a number of beams of an antenna body of the single-beam antenna.

15. The array antenna configuration method according to claim 14, wherein the adjusting comprises adjusting, when a position of the planar reflection board is fixed, a position of the beam set, wherein the antenna body is configured by the adjusting the position of the beam set to transmit or receive the beam set in parallel after being reflected by the planar reflection board.

16. The array antenna configuration method according to claim 14, wherein the adjusting comprises adjusting, when a position of the antenna body is fixed, a position of the planar reflection board, wherein the antenna body is configured by the adjusting the position of the planar reflection board to transmit or receive the beam set in parallel after being reflected by the planar reflection board.

17. The array antenna configuration method according to claim 16, wherein:

the adjusting is performed using a hinge, a gemel, or an electric motor.

18. The array antenna configuration method according to claim 14, wherein the adjusting comprises adjusting, when a number or position of beams in the beam set is changed, a position of the planar reflection board, wherein the antenna body is configured by the adjusting the position of the planar reflection board to transmit or receive the beam set in parallel after being reflected by the planar reflection board.

* * * * *